US005145455A

United States Patent [19]

Todd

[11] Patent Number: 5,145,455

[45] Date of Patent: Sep. 8, 1992

[54] WAVE-TYPE COIN SORTER

[75] Inventor: William M. Todd, Tullahoma, Tenn.

[73] Assignee: Cummins-Allison Corp., Mt. Prospect, Ill.

[21] Appl. No.: 701,447

[22] Filed: May 15, 1991

[51] Int. Cl.[5] ..... G07D 3/00

[52] U.S. Cl. ..... 453/6

[58] Field of Search ..... 453/6, 10, 32

[56] References Cited

U.S. PATENT DOCUMENTS

| | | | |
|---|---|---|---|
| 4,086,928 | 5/1978 | Ristvedt . | |
| 4,098,280 | 6/1978 | Ristvedt . | |
| 4,506,685 | 3/1985 | Childers et al. . | |
| 4,543,969 | 10/1985 | Rasmussen | 453/10 |
| 4,549,561 | 10/1985 | Johnson et al. | 453/10 |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman | 453/32 X |
| 4,607,649 | 8/1986 | Taiple et al. . | |
| 4,681,128 | 7/1987 | Ristvedt et al. . | |
| 4,731,043 | 3/1988 | Ristvedt | 453/6 |
| 4,775,353 | 10/1988 | Childers et al. . | |
| 4,775,354 | 10/1988 | Rasmussen | 453/10 |
| 4,863,414 | 9/1989 | Ristvedt et al. . | |
| 4,921,463 | 5/1990 | Primdahl et al. . | |
| 4,966,570 | 10/1990 | Ristvedt et al. | 453/6 |
| 5,009,627 | 4/1991 | Rasmussen | 453/10 |
| 5,011,455 | 4/1991 | Rasmussen | 453/32 X |
| 5,022,889 | 6/1991 | Ristvedt et al. | 453/6 |
| 5,026,320 | 6/1991 | Rasmussen . | |

*Primary Examiner*—F. J. Bartuska
*Attorney, Agent, or Firm*—Arnold, White & Durkee

[57] ABSTRACT

A coin sorting apparatus for receiving and sorting mixed coins by denomination, the apparatus having a rotatable disc having a resilient surface for receiving the coins and imparting rotational movement to the coins, and a stationary sorting head having a contoured surface spaced slightly away from and generally parallel to the resilient surface of the rotatable disc. The stationary sorting head includes a recess for guiding the coins on the rotatable disc into a single file of coins, a referencing wall for guiding one edge of the coins in the single file along a prescribed path, and a first exit channel for receiving the largest-diameter coins from the end of the referencing wall and guiding those coins to a first exit station on the periphery of the sorting head. A bypass guide wall intercepts all the other coins from the end of the referencing wall and guides the intercepted coins inwardly around the first exit channel. Additional exit channels receive and guide successive denominations of the intercepted coins to successive exit stations on the periphery of the sorting head.

3 Claims, 5 Drawing Sheets

12
22
26
22a
21
30
31
23
25
24
23
H1
40
41
H
43
42
20
21
54
50¢
44
45
50
55
51
53
52
51.

12
30
31
H1
100
101
43
42
20
22a
25
120
111
110
121
53
52

WAVE-TYPE COIN SORTER

FIELD OF THE INVENTION

The present invention relates generally to coin sorting devices and, more particularly, to coin sorters of the type which use a resilient disc rotating beneath a stationary sorting head for sorting coins of mixed denominations.

SUMMARY OF THE INVENTION

It is a primary object of the present invention to provide an improved disc-type coin sorter which is capable of sorting coins in descending order of size, so that the largest coins are the first to be discharged from the sorter, without the use of auxiliary devices on the sorting head.

Another related object of the invention is to provide such an improved coin sorter which can be efficiently and economically manufactured.

Other objects and advantages of the invention will be apparent from the following detailed description and the accompanying drawings.

In accordance with the present invention, the foregoing objectives are realized by providing a coin-sorting system having a rotatable disc with a resilient surface for receiving coins of mixed denominations and imparting rotational movement to the coins; means for rotating the disc; a stationary guide plate having a contoured surface spaced slightly away from and generally parallel to the resilient surface of the rotatable disc, the stationary guide plate including a recess for guiding the coins on the rotatable disc into a single file of coins, referencing means for guiding one edge of the coins in the single file along a prescribed path, a first exit channel for receiving the largest-diameter coins from the end of said referencing means and guiding those coins to a first exit station on the periphery of the sorting head, first guide means for intercepting all the other coins from the end of the referencing means and guiding the intercepted coins inwardly around the first exit channel, multiple exit channels for receiving and guiding successive denominations of said intercepted coins to successive exit stations on the periphery of said sorting head.

In a preferred embodiment, the coins guided around the first exit channel are guided outwardly toward the periphery of the sorting head where a second exit channel receives the largest-diameter coins from the first guide means and guides those coins to a second exit station on the periphery of the sorting head, second guide means intercepts all the other coins from the first guide means and guides the intercepted coins inwardly around the second exit channel and then outwardly toward the periphery of the sorting head, and a third exit channel receives the largest-diameter coins from the second guide means and guides those coins to a third exit station on the periphery of the sorting head.

DESCRIPTION OF THE PREFERRED EMBODIMENT

Figure 1:
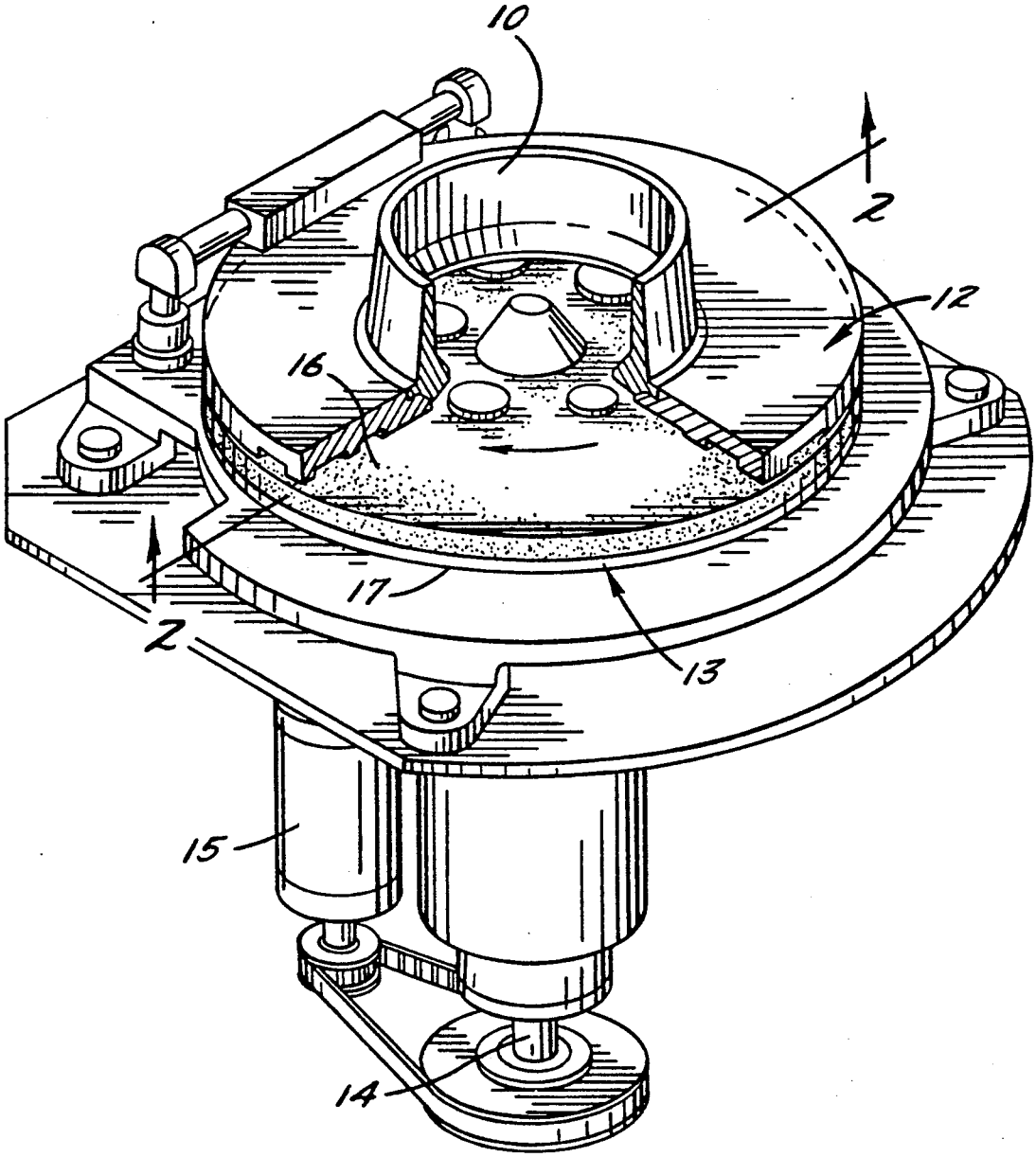
FIG. 1 is a perspective view of a coin sorter embodying the present invention, with portions thereof broken away to show the internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a central opening in an annular sorting head or guide plate 12. As the coins pass through the central opening, they are deposited on the top surface of a rotatable disc 13. This disc 13 is mounted for rotation on a stub shaft 14 and driven by an electric motor 15. The disc 13 comprises a resilient pad 16, preferably made of a resilient rubber or polymeric material, bonded or held to the top surface of a rigid disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin.

Figure 2:
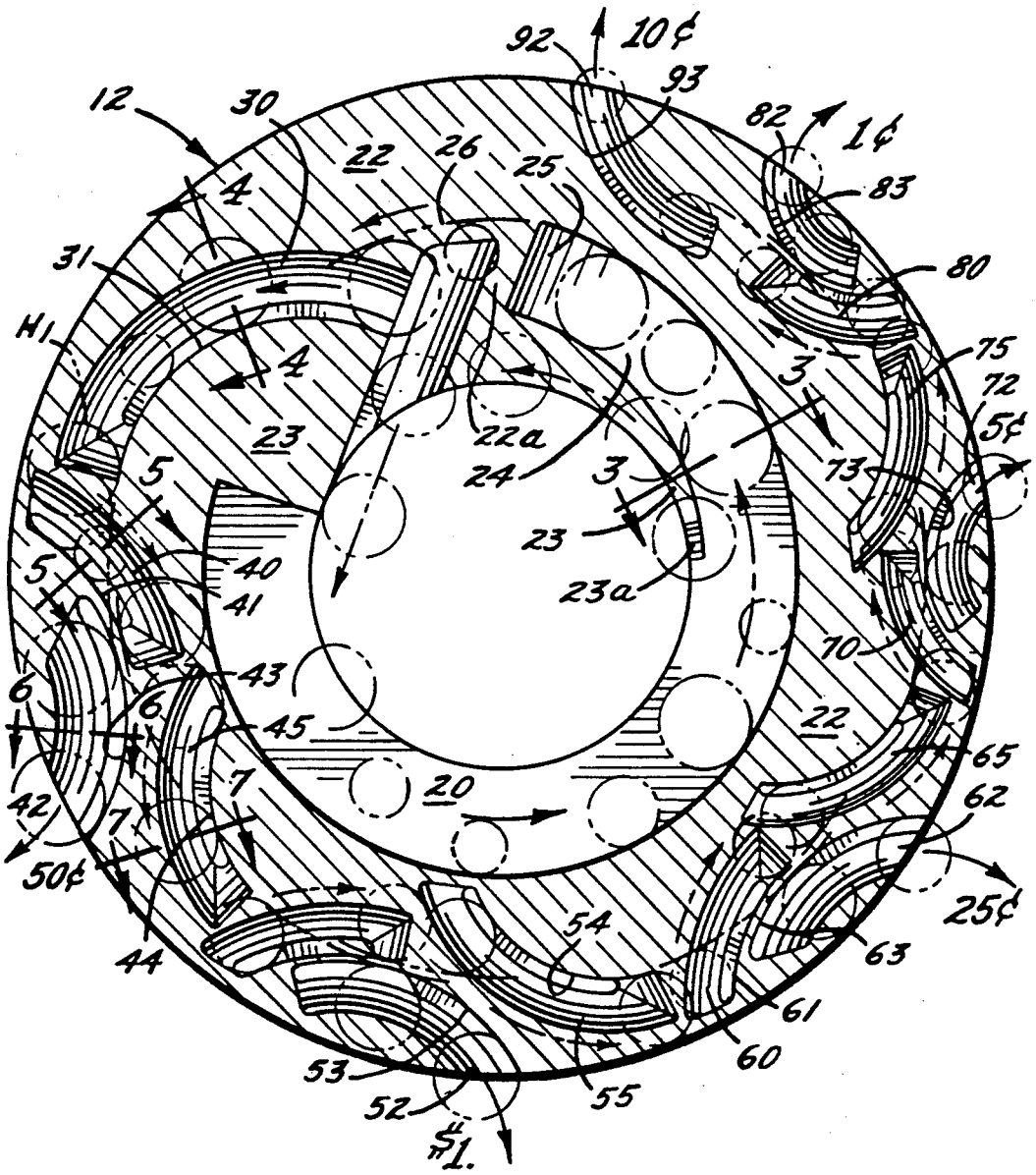
FIG. 2 is an enlarged bottom plan view of the sorting head in the coin sorter shown in FIG. 1, taken generally along line 2—2 in FIG. 1.
Figure 3:
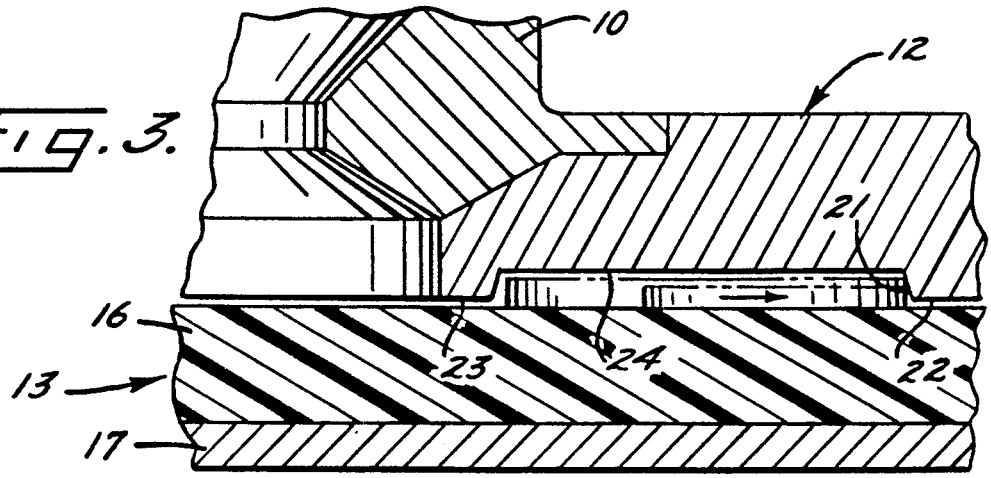
FIG. 3 is a section taken generally along line 3—3 in FIG. 2.

As can be seen most clearly in FIG. 2, the outwardly moving coins initially enter an annular recess 20 formed in the underside of the guide plate 12 and extending around a major portion of the inner periphery of the annular guide plate. The outer wall 21 of the recess 20 extends downwardly to the lowermost surface 22 of the guide plate (see FIG. 3), which is spaced from the top surface of the pad 16 by a distance, e.g., 0.010 inch, which is slightly less than the thickness of the thinnest coin. Consequently, the initial radial movement of the coins is terminated when they engage the wall 21 of the recess 20, though the coins continue to move circumferentially along the wall 21 by the rotational movement of the pad 16.

The major portion of the central opening of the guide plate 12 which does not open directly into the recess 20 is that sector of the periphery which is occupied by a land 23 whose lower surface is at the same elevation as the lowermost surface 22 of the guide plate. As single-layer coins within the recess 20 approach the land 23, those coins move outwardly around the land 23 and into a spiral channel 24 which is an outward extension of the inner peripheral recess 20. The channel 24 is preferably just slightly wider than the diameter of the coin denomination having the greatest diameter. The top surface of the channel 24 is spaced away from the top of the pad 16 by a distance that is just slightly greater than the thickness of the thickest coin so that the coins move radially outwardly into engagement with the outer wall 21 of the channel 25 as they are rotated through the channel 24 (see FIG. 3). Thus, as seen in FIG. 2, coins which move into the channel 24 are all rotated into engagement with the outwardly spiralling wall 21, and continue to move through the channel 24 with the outer edges of all the coins riding along the spiral wall 21.

When two or more coins are stacked on top of each other, they may be pressed into the resilient pad 16 even within the deep peripheral recess 20. Consequently, stacked coins can be located at different radial positions within the recess 20 as they approach the land 23. When such a pair of stacked coins has only partially entered the recess 20, they engage a ramp 23*a* on the leading edge of the land 23. The ramp 23*a* presses the stacked coins downwardly into the resilient pad 16, which retards the lower coin while the upper coin continues to be advanced. Thus, the stacked coins are stripped apart so that they can be recycled and once again enter the recess 20, this time in a single layer.

Rotation of the pad 16 continues to move the coins along the wall 21 until those coins engage a ramp 25 sloping downwardly from the channel 24 to a region 22*a* of the lowermost surface 22 of the guide plate 12. Because the surface 22*a* is located even closer to the pad 16 than the upper surface of the channel 24, the effect of the ramp 25 is to further depress the coins into the resilient pad 16 as the coins are advanced along the ramp by the rotating disc. This causes the coins to be firmly gripped between the guide plate surface region 22*a* and the resilient pad 16, thereby securely holding the coins in a fixed radial position 26 as they continue to be rotated along the underside of the guide plate by the rotating disc.

Figure 4:
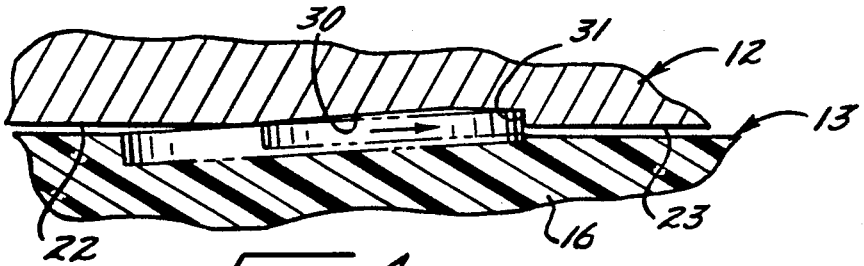
FIG. 4 is an enlarged section taken generally along line 4—4 in FIG. 2.

As the coins are rotated along the region 22*a*, they enter a referencing region containing an arcuate channel 30 whose inner wall 31 spirals outwardly. The cross-sectional profile of the channel 30 is shown in FIG. 4. The deepest portion of the channel 30 is adjacent the inner guide wall 31 which intercepts the inner edges of the coins of all denominations as they are rotated with their outer edges following the common radius 26. The outer portion of the channel 30 slopes downwardly to the lowermost surface 22 of the sorting head, so that the outer portions of the coins of all denominations are pressed downwardly as they are carried along the channel 30 by the rotating pad 16. This causes the inner portions of the coins to be tilted upwardly against the guide wall 31 to ensure firm engagement therewith. As can be seen from FIG. 2, the inner edges of coins of different denominations initiate engagement with the guide wall 31 at different annular positions along the guide wall. The engaged coins are then gradually moved outwardly along the spiral wall 31 so that the inner edges of the coins of all denominations exit from the channel 30 at a common radius.

Figure 5:
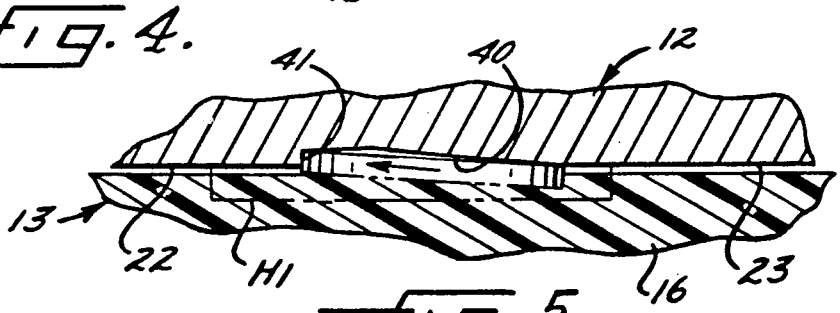
FIG. 5 is an enlarged section taken generally along line 5—5 in FIG. 2.
Figure 6:
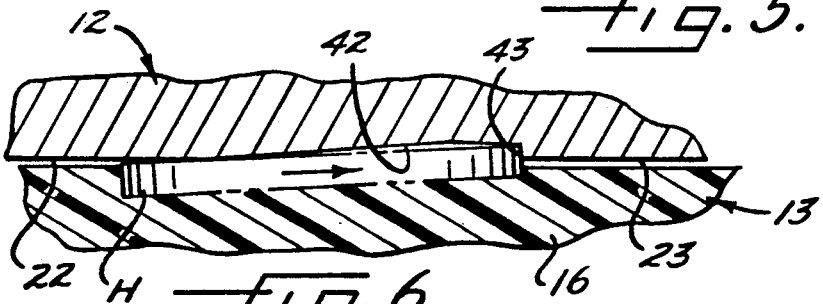
FIG. 6 is an enlarged section taken generally along line 6—6 in FIG. 2.
Figure 7:
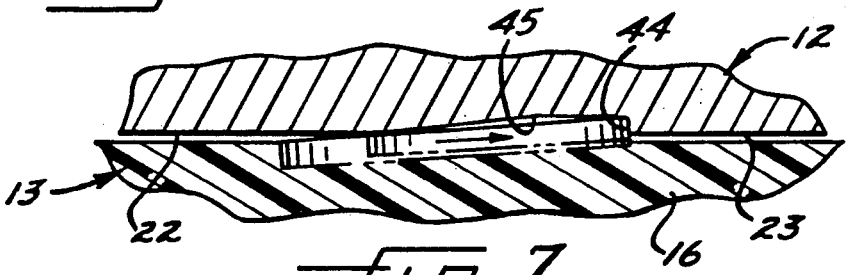
FIG. 7 is an enlarged section taken generally along line 7—7 in FIG. 2.

As the coins emerge from the referencing recess 30, all the coins except the largest-diameter denomination (e.g., the half dollar) are intercepted by a bypass recess 40 which forms an outer guide wall 41 for engaging the outer edges of the intercepted coins and guiding them inwardly. The outer edges of the largest-diameter coins extend outwardly beyond the outer end of the recess 40, as illustrated by the half dollar H1, in FIGS. 2 and 5, and thus are carried across the recess 40 to an exit channel 42. The inner wall 43 of the exit channel 42 intercepts the inner edges of the half dollars H as they are rotated along a constant-radius path by virtue of being pressed firmly into the resilient pad after exiting from the channel 30. After the inner edge of a half dollar is intercepted by the exit-channel wall 43, that coin is guided outwardly by the wall 43 to the half-dollar exit station at the periphery of the sorting head.

Meanwhile, all the coins smaller than the half dollars are shunted around the inner end of the exit channel 42 by the wall 41 of the bypass recess 40. As these coins leave the recess 40, their inner edges are intercepted by the inner wall 44 of a re-gaging recess 45. The wall 44 guides the coins outwardly toward the periphery of the sorting head. At the outer end of the re-gaging recess 45, all the coins except the largest-diameter denomination (e.g., the Susan B. Anthony dollar coins) are intercepted by a bypass recess 50 which forms an outer guide wall 51 for engaging the outer edges of the intercepted coins and guiding them inwardly. The outer edges of the dollar coins extend outwardly beyond the outer end of the recess 50, and thus are carried across the recess 50 to an exit channel 52. The inner wall 53 of the exit channel 52 intercepts the inner edges of the dollar coins as they are rotated along a constant-radius path by virtue of being pressed firmly into the resilient pad after exiting from the channel 45. After the inner edge of a dollar coin is intercepted by the exit-channel wall 53, that coin is guided outwardly by the wall 53 to the dollar exit station at the periphery of the sorting head.

All the coins smaller than the dollar coins are shunted around the inner end of the exit channel 52 by the wall 51 of the bypass recess 50. As these coins leave the recess 50, their inner edges are intercepted by the inner wall 54 of a re-gaging recess 55. The wall 54 guides the coins outwardly toward the periphery of the sorting head. At the outer end of the re-gaging recess 55, all the coins except the quarters are intercepted by a bypass recess 60 which functions in the same manner as the bypass recesses 40 and 50 described above.

The operation of the sorting head is similar for the remaining four coin denominations, namely the quarter, nickle, penny and dime. The quarters are carried across the bypass recess 60 and discharged through an exit channel 62, being intercepted and guided by the inner wall 63 of that channel. The remaining denominations pass through the bypass channel 60 to a re-gaging channel 65, and the nickels are discharged through an exit channel 72 along the inner wall 73 of that channel. The pennies and dimes bypass the exit channel 72 via a bypass channel 70, and then are re-gaged by a channel 75. The pennies proceed from the re-gaging channel 75 to an exit channel 82, while the dimes are bypassed around the exit channel 82 by means of a bypass channel 80 and then are discharged through an exit channel 92. The dimes are gaged by the outer wall of the bypass channel 80, and no re-gaging is needed prior to the last exit channel 92 because there is only one coin denomination remaining at this point.

One of the advantages of this invention is that it enables the larger coins to be discharged before the smaller coins. In the event of a missort, larger coins can cause more damage than smaller coins, so it is desirable to remove the larger coins from the system as early as possible.

Figure 8:
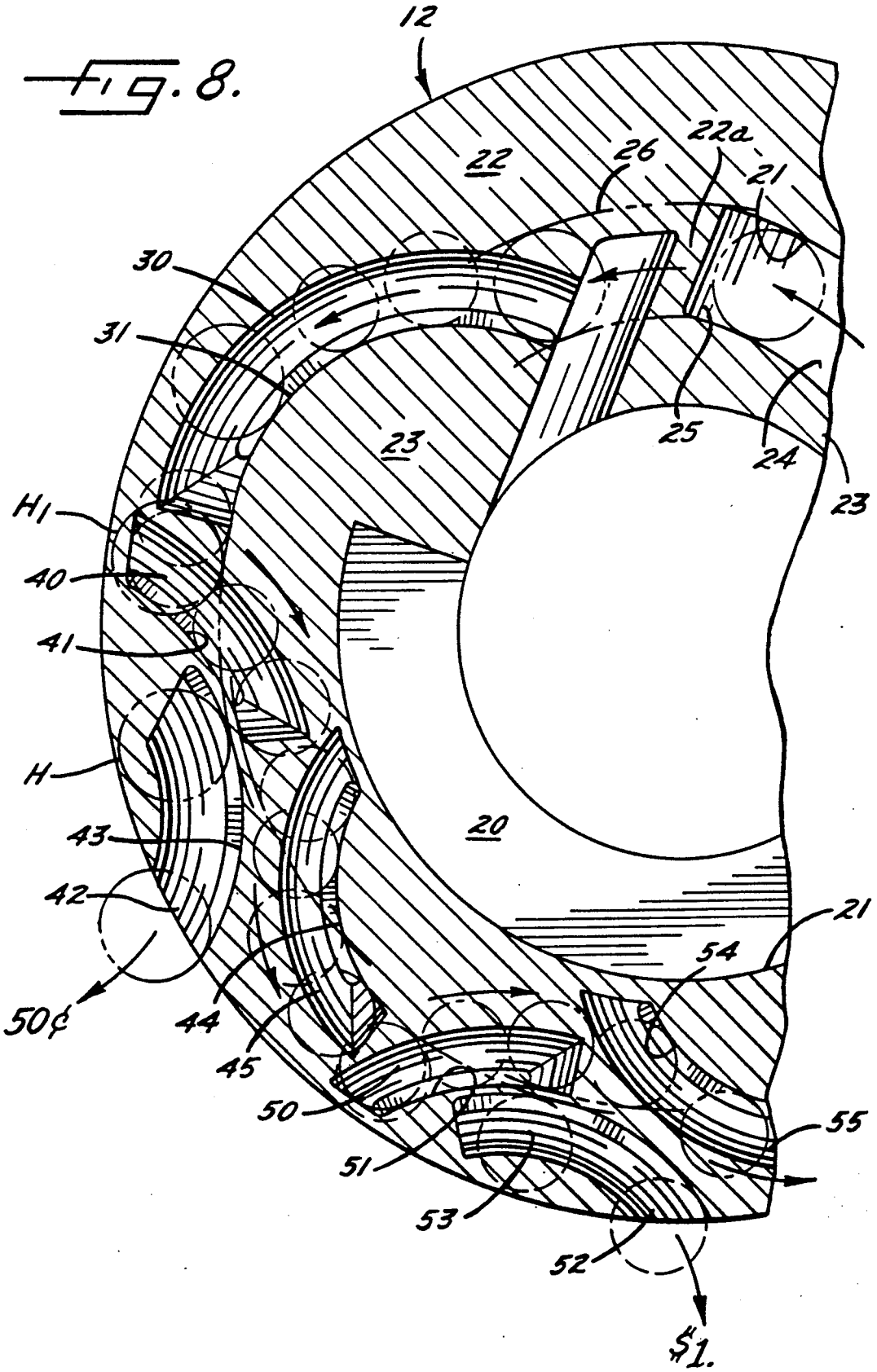
FIG. 8 is an enlargement of the left-hand portion of the bottom plan view of the sorting head of FIG. 2 and illustrating various coin denominations passing therethrough.
Figure 9:
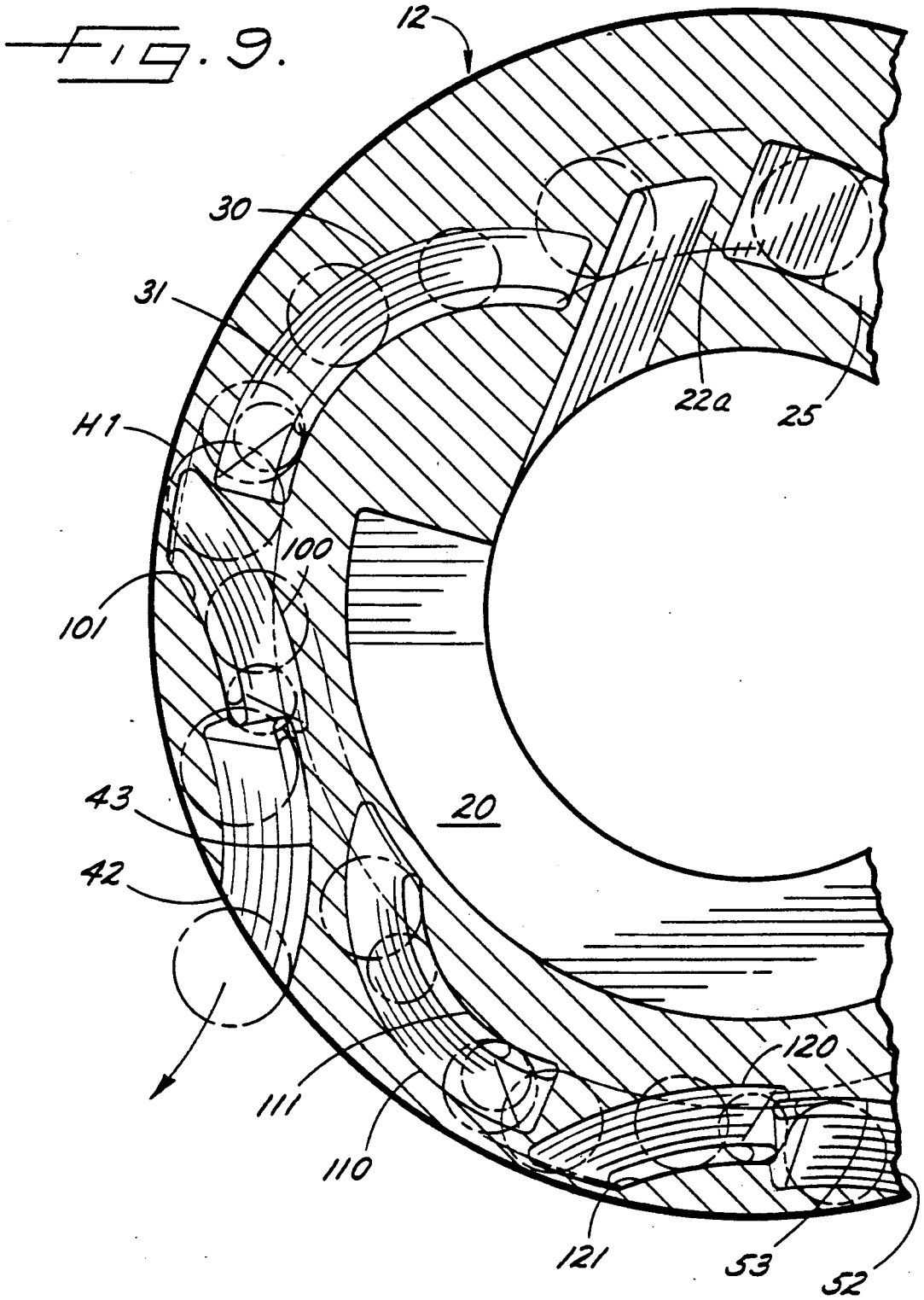
FIG. 9 is a view similar to FIG. 8 of a modified sorting head embodying the invention.

FIG. 9 illustrates a modified sorting head which is more compact in the radial direction. Channels which are the same as those in FIG. 8 have been assigned the same reference numerals in FIG. 9. The first difference in the design of FIG. 9 is the bypass recess 100. The outer wall 101 of this recess does not guide the outer edges of the coins therein inwardly beyond the inner edge of the first exit channel 42, but rather guides the coins inwardly just far enough to prevent them from being captured in the exit channel 42. The coins in the bypass recess 100 are thus carried past the exit channel 42 to a re-gaging channel 110.

The re-gaging channel 110 performs the same functions as the re-gaging channel 44, but the inner wall 111 of the channel 110 extends inwardly just far enough to intercept the largest coin from the bypass recess 100. Of course, the re-gaging channel 110 also intercepts all other coins from the bypass recess 100. All these coins are guided outwardly by the wall 111 to position the largest coin for entry into the second exit channel 52. The smaller coins are all intercepted by a second bypass recess 120 which, like the recess 100, guides the intercepted coins inwardly just far enough to prevent them from entering the exit channel 52.

I claim:

1. A coin sorting apparatus for receiving and sorting mixed coins by denomination, said apparatus comprising:

a rotatable disc having a resilient surface for receiving said coins and imparting rotational movement to said coins; and a stationary sorting head having a contoured surface spaced slightly away from and generally parallel to said resilient surface of said rotatable disc, said stationary sorting head including a recess for guiding said coins on said rotatable disc into a single file of coins, referencing means for guiding one edge of said coins in said single file along a prescribed path, a first exit channel for receiving the largest-diameter coins from the end of said referencing means and guiding those coins to a first exit station on the periphery of said sorting head, bypass guide means for intercepting all the other coins from the end of said referencing means and guiding the intercepted coins inwardly around said first exit channel, said bypass guide means comprising a bypass guide wall for engaging and guiding the outer edges of the respective coins inwardly beyond the innermost edge of said first exit channel, a re-gaging guide wall for intercepting the coins from the end of the bypass guide wall and guiding the inner edges of those coins outwardly to a prescribed radius, and multiple exit channels for receiving and guiding successive denominations of said intercepted coins to successive exit stations on the periphery of said sorting head.

2. The coin sorting apparatus of claim 1 wherein the outer end of said bypass guide means is spaced radially inwardly from the outer edges of said largest-diameter coins received by said first exit channel around which the other coins are guided by the bypass guide means.

3. A coin sorting apparatus for receiving and sorting mixed coins by denomination, said apparatus comprising:

a rotatable disc having a resilient surface for receiving said coins and imparting rotational movement to said coins; and a stationary sorting head having a contoured surface spaced slightly away from and generally parallel to said resilient surface of said rotatable disc, said stationary sorting head including a recess for guiding said coins on said rotatable disc into a single file of coins, referencing means for guiding one edge of said coins in said single file along a prescribed path, a first exit channel for receiving the largest-diameter coins from the end of said referencing means and guiding those coins to a first exit station on the periphery of said sorting head, first guide means for intercepting all the other coins from the end of said referencing means and guiding the intercepted coins inwardly around said first exit channel and then outwardly toward the periphery of the sorting head, a second exit channel for receiving the largest-diameter coins from said first guide means and guiding those coins to a second exit station on the periphery of said sorting head, second guide means for intercepting all the other coins from said first guide means and guiding the intercepted coins inwardly around said second exit channel and then outwardly toward the periphery of the sorting head, and a third exit channel for receiving the largest-diameter coins from said second guide means and guiding those coins to a third exit station on the periphery of said sorting head.

* * * * *